US006383010B1

(12) United States Patent
Mayo et al.

(10) Patent No.: US 6,383,010 B1
(45) Date of Patent: May 7, 2002

(54) LATCHING SYSTEM FOR ELECTRICAL CONNECTORS

(75) Inventors: Michael Mayo, Lockport; Yew Tek Yap, Naperville; Jose H. Chavez, Jr., Romeoville; Yan Margulis, Buffalo Grove, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/840,249

(22) Filed: Apr. 23, 2001

(51) Int. Cl.[7] ..... H01R 13/627
(52) U.S. Cl. ..... 439/357; 439/79
(58) Field of Search ..... 439/79, 83, 81, 439/352, 353, 354, 357, 677, 680

(56) References Cited

U.S. PATENT DOCUMENTS

| | | | | |
|---|---|---|---|---|
| 4,526,433 A | | 7/1985 | Tanaka | 339/75 |
| 5,158,473 A | | 10/1992 | Takahashi et al. | 439/353 |
| 5,201,661 A | * | 4/1993 | Li | 439/79 |
| 5,234,357 A | | 8/1993 | Yamaguchi | 439/354 |
| 5,472,354 A | * | 12/1995 | Chen et al. | 439/357 |
| 5,486,117 A | | 1/1996 | Chang | 439/357 |
| 5,695,355 A | | 12/1997 | Hasenfratz et al. | 439/357 |
| 5,855,484 A | | 1/1999 | Hennessey et al. | 439/79 |

* cited by examiner

*Primary Examiner*—P. Austin Bradley
*Assistant Examiner*—Alexander Gilman
(74) *Attorney, Agent, or Firm*—Stephen Z. Weiss

(57) ABSTRACT

An electrical connector includes a dielectric housing having a front mating face and mounting a plurality of terminals. A latching cavity is formed in the front mating face for receiving a latch member from a complementary mating device. The cavity includes opposite side walls. A latch/solder member is mounted on the housing and includes a latch plate in the latching cavity for latching engagement by the latch member of the complementary connecting device, and a solder plate at the board-mounting face of the housing. A blocking rib spans the side walls of the latching cavity to strengthen the housing, and the locking rib prevents the latch member of the complementary connecting device from being inserted into the cavity on a wrong side of the latch plate.

9 Claims, 3 Drawing Sheets

LATCHING SYSTEM FOR ELECTRICAL CONNECTORS

FIELD OF THE INVENTION

This invention generally relates to the art of electrical connectors and, particularly, to a system for latching a pair of mating connectors.

BACKGROUND OF THE INVENTION

A typical electrical connector assembly includes a pair of electrical connectors which are mateable to interengage conductive terminals on the connectors to establish electrical circuits through the connector interface. Each connector typically includes a dielectric housing within which the terminals are mounted. The mating connectors are mateable in a given direction.

Most often, the mating connectors of a connector assembly have some form of latching system to hold the connectors in mated condition. Sometimes the latching system is releasable to allow for the connectors to be unmated. Just one example is in a holding frame and a portable data entry device. One connector of the connector assembly is mounted on the holding frame, and the other connector of the assembly is mounted on the portable data entry device. The holding frame has what is called a "docking port" for receiving the portable data entry device. It is desirable to provide a secure latching mechanism to hold the portable data entry device in the docking port of the holding frame to maintain the electrical connectors in mated condition.

One of the problems with latching systems for electrical connectors as described above is the potential of damage to the latches, themselves. In other words, the portable data entry device often is hastily positioned on the holding frame of the docking port with the respective latches of the devices misaligned or improperly inserted. The result may be inadvertent damage to the latches.

Another problem with such systems is that the connector of the portable data entry device is a small, elongated and narrow structure which includes a housing molded of dielectric plastic material or the like. When latching cavities are formed in the very narrow housing, open spaces are created which tend to allow the molded plastic housing to bow. The connector is designed for mounting on a printed circuit board, and even the slightest bowing of the housing prevents the connector from lying completely flat on the circuit board.

The present invention is directed to solving these various problems of the prior art.

SUMMARY OF THE INVENTION

An object, therefore, of the invention is to provide a new and improved latching system for an electrical connector assembly.

Another object of the invention is to provide a new and improved latch means on an electrical connector adapted for mounting on a printed circuit board, the connector being mateable with a complementary connecting device.

In the exemplary embodiment of the invention, the connector includes a dielectric housing having an upper surface, a lower board-mounting surface and a front mating face extending generally transversely between the surfaces. A plurality of terminals are mounted on the housing. At least one latching cavity is formed in the front mating face of the housing for receiving a latch member from the complementary mating device. The cavity includes opposite side walls extending inwardly of the mating face and generally perpendicular to the upper and lower surfaces of the housing. A combination latch and solder member is mounted on the housing and includes a latch plate in the latching cavity between the opposite side walls thereof and a solder plate at the board-mounting face of the housing. The latch member of the complementary connecting device is latchingly engageable with the latch plate at one side thereof. A blocking section is provided in the latching cavity at an opposite side of the latch plate from the one side thereof to prevent the latch member of the complementary connecting device from being inserted into the cavity on the opposite side of the latch plate.

According to one aspect of the invention, the dielectric housing is molded of plastic material, and the blocking section is molded integrally therewith. The blocking section comprises a rib extending between the opposite side walls of the latching cavity. In one embodiment of the invention, the rib is spaced from the latch plate and from the boardmounting face of the housing.

In another embodiment of the invention, the integrally molded rib is generally coincident with the board-mounting face of the housing. The molded plastic material of the rib projects through an opening in the solder plate to form a locating peg for insertion into an appropriate locating hole in the printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
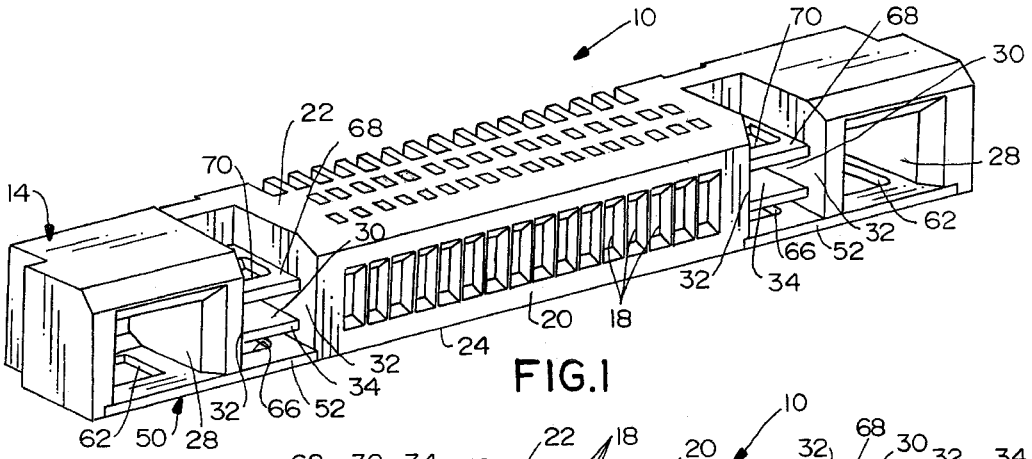
FIG. 1 is a top, front perspective view of an electrical connector incorporating the concepts of the invention.
Figure 2:
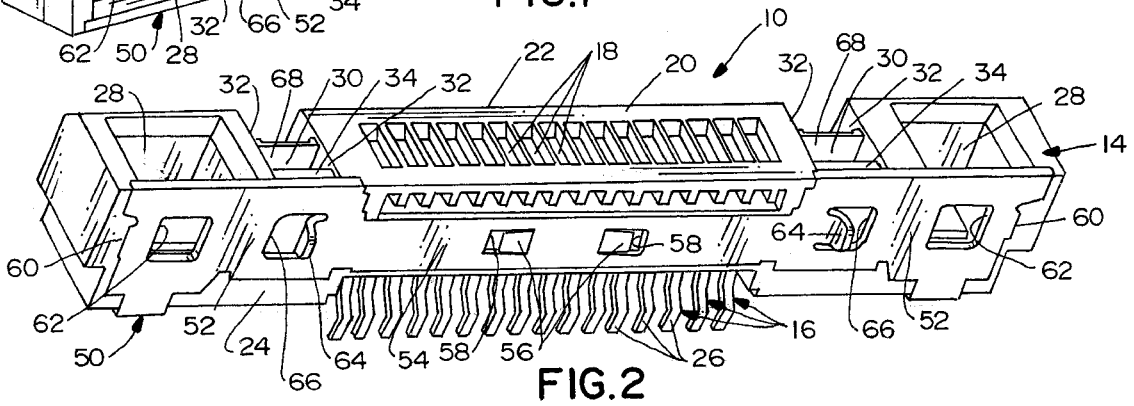
FIG. 2 is a bottom, front perspective view of the connector of FIG. 1.
Figure 3:
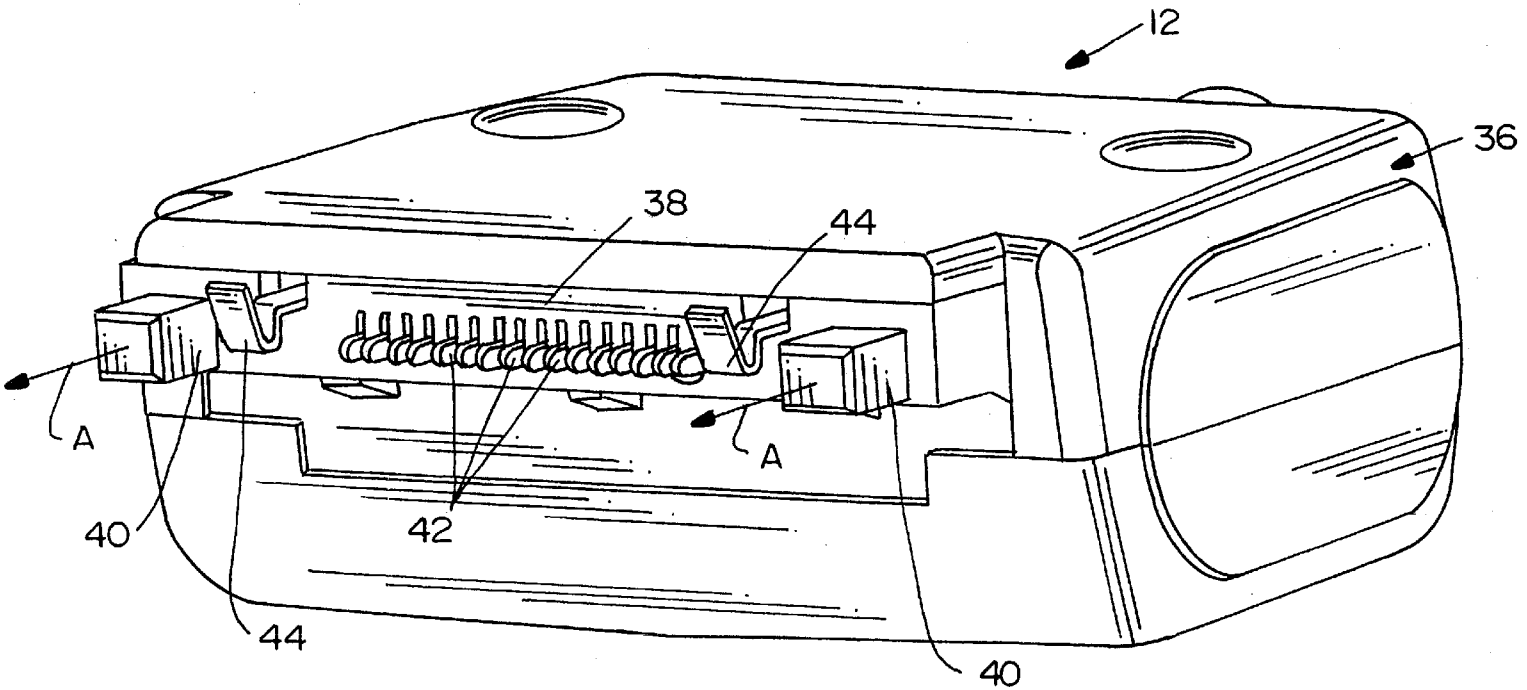
FIG. 3 is a perspective view of a complementary mating device or connector which is mateable with the connector of FIGS. 1 and 2.

Referring to the drawings in greater detail, FIGS. 1 and 2 show a first embodiment of an electrical connector, generally designated 10, incorporating the concepts of the invention. FIG. 3 shows a complementary connecting device or second connector, generally designated 12, which is mateable with connector 10 in the direction of arrow "A". Connector 10 is of a type used in a portable data entry device, and complementary connector 12 is of a type used in a docking port of a holding frame for the portable data entry device. However, it should be understood that the invention is not limited to the specific connectors shown nor the specific stated use.

Connector 10 includes an elongated dielectric housing, generally designated 14, which may be molded of plastic material or the like. The housing mounts a plurality of conductive terminals, generally designated 16, in a linear array. The terminals have contact portions (not shown) in a plurality of terminal-receiving passages 18 which open at a front mating face 20 of the housing. The housing has an upper or top surface 22 and a lower or bottom surface 24. Connector 10 is adapted for mounting on a printed circuit board, and bottom surface 24 forms the board-mounting surface of the housing. Terminals 16 have tail portions 26 (FIG. 2) which are generally coplanar with board-mounting surface 24.

Molded plastic housing 14 of connector 10 further includes a pair of locating holes 28 near opposite ends of the elongated housing, the holes opening at front mating face 20 of the housing. A pair of latching cavities 30 are formed immediately inside locating holes 28, but outside the linear array of terminal-receiving passages 18. Latching cavities 30 open at front mating face 20 of the housing and include opposite side walls 32 which extend inwardly of the mating face and generally perpendicular to top and bottom surfaces 22 and 24, respectively, of the housing. Finally, a rib 34 is molded integrally with the housing and spans opposite side walls 32 of each latching cavity 30. The rib is spaced from boardmounting surface 24 of the housing.

Referring to FIG. 3, complementary mating connector 12 includes a dielectric housing, generally designated 36, which includes a mating face 38. The housing may be molded of plastic material and includes a pair of locating posts 40 molded integrally therewith and projecting forwardly of mating face 38. Locating posts 40 are sized and spaced for insertion into locating holes 28 (FIGS. 1 and 2) of connector 10. Housing 36 of mating connector 12 mounts a plurality of terminals which have contact portions 42 projecting forwarding of mating face 38 for insertion into terminal-receiving passages 18 (FIGS. 1 and 2) in front mating face 20 of connector 10 and for engagement with the contact portions of terminals 16. Finally, mating connector 12 has a pair of spaced latch members in the form of latch hooks 44 to latch the mating connector in mated condition with connector 10, as described hereinafter.

Figure 4:
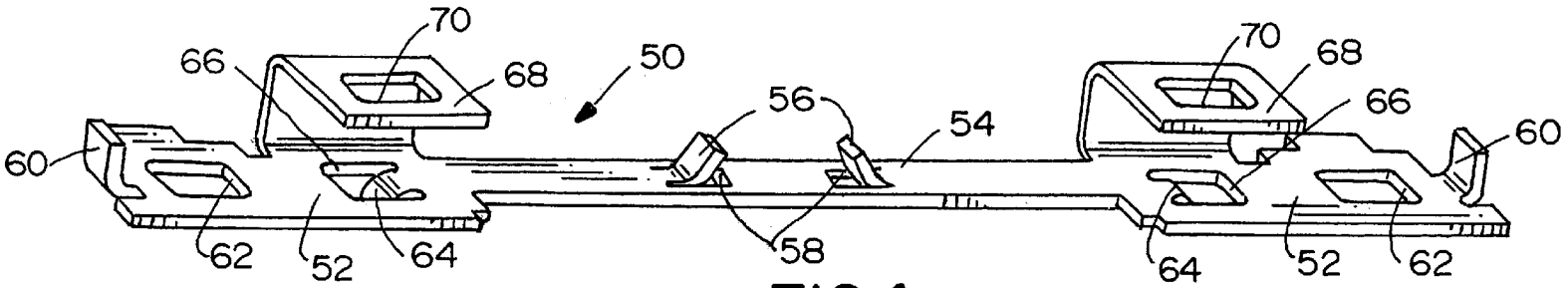
FIG. 4 is a top perspective view of the combination latch/solder member of the connector of FIGS. 1 and 2.
Figure 5:
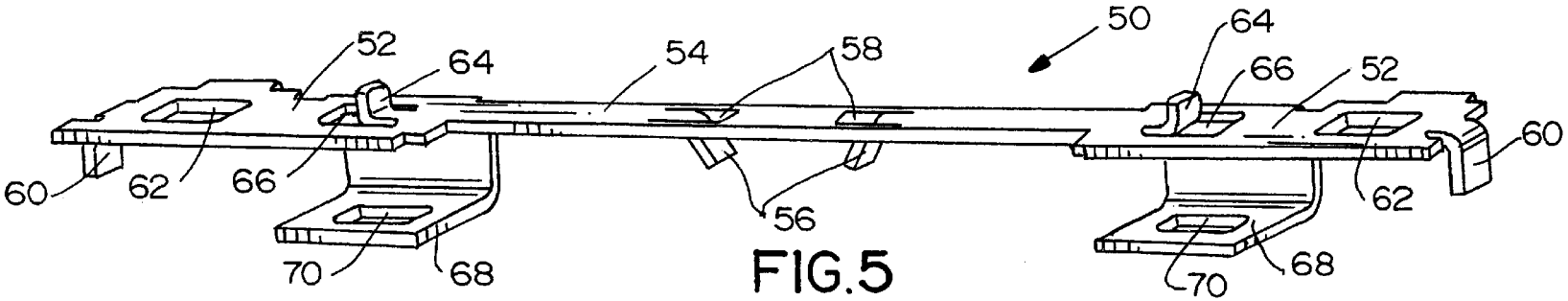
FIG. 5 is a bottom perspective view of the latch/solder member of FIG. 4.

FIGS. 4 and 5 show a combination latch/solder member, generally designated 50, which is mounted on housing 14 of connector 10 by overmolding the latch/solder member with the plastic material of the housing. Specifically, latch/solder member 50 is elongated and includes a pair of end portions 52 joined by a longitudinal central portion 54. The member is stamped and formed of sheet metal material and includes a pair of central retention pegs 56 stamped and formed out of a pair of openings 58 in central portion 54. A pair of retention pegs 60 are formed from the extreme outer edges of end portions 52. A pair of retention holes 62 are formed in end portions 52. Latch/solder member 50 is overmolded with the molding of housing 14 of connector 10. The molded plastic material substantially surrounds end portions 52 and central portion 54 and into retention holes 62, as retention pegs 56 and 60 become embedded in the plastic material. Therefore, the latch/solder member becomes totally secured to the housing of connector 10, with central portion 54 and end portions 52 generally flush with board-mounting surface 24 of the connector housing as best seen in FIG. 2.

End portions 52 of latch/solder member 50 generally comprise solder plates for connection, as by soldering, to appropriate pads on the printed circuit board. Still referring to FIGS. 4 and 5, a pair of locating pegs 64 are stamped and formed out of openings 66 in end portions or solder plates 52. These locating pegs are provided for insertion into appropriate locating holes in the printed circuit board. Finally, a pair of latch plates 68 are formed from latch/solder member 50 so as to be spaced from and generally parallel to solder plates 52. The latch plates include latching holes 70 which are in alignment with openings 66 in solder plates 52 from which locating pegs 64 are formed.

With the above description of latch/solder member 50 in FIGS. 4 and 5, reference now is made back to FIGS. 1 and 2 and particularly the area of latching cavities 30. It can be seen that solder plates 52 at opposite ends of latch/solder member 50 close-off the bottom ends of latching cavities 24, with locating pegs 64 and openings 66 in the solder plates in alignment with the latching cavities. It also can be seen that latch plates 68 project forwardly into latching cavities 24 generally parallel to solder plates 52. Integrally molded ribs 34 can be seen to be spaced between solder plates 52 and latch plates 68. During molding, appropriate "core pins" of a molding die assembly are located on opposite sides of ribs 34 and latch plates 68 to form latching cavities 30 and to prevent the molten plastic material from passing through openings 66 in the solder plates or through latching holes 70 in the latch plates.

From the foregoing, it can be understood that blocking sections or ribs 34 which span side walls 32 of latching cavities 30 perform dual functions. First, by integrally joining side walls 32 of the latching cavities, ribs 34 prevent bowing of the connector housing in the otherwise weakened areas of the latching cavities. Second, ribs 34 form blocking sections to prevent latch hooks 44 (FIG. 3) of mating connector 12 from being inserted into the cavities on the wrong (bottom) side of latch plates 68. In other words, when mating connector 12 is mated with connector 10 by inserting locating posts 40 of the mating connector into locating holes 28, latch hooks 44 are designed for snap-latching engagement into latching holes 70 of latch plates 68 from the top sides thereof as viewed in FIGS. 1 and 4. If attempts are made to mate the connectors misaligned from this intended orientation, without blocking ribs 34 there would be a tendency to damage the interengaging latching components. Therefore, integrally molded ribs 34 perform dual functions of strengthening connector housing 14 as well as ensuring proper engagement of latch hooks 44 of connector 12 with latch plates 68 of connector 10.

Figure 6:
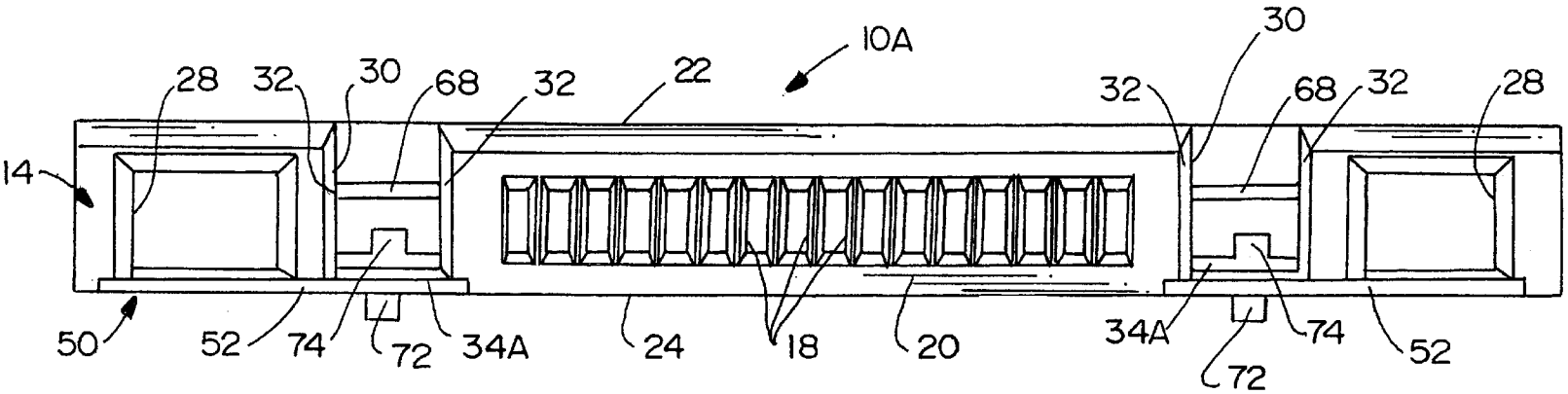
FIG. 6 is a front elevational view of the mating face of an alternate embodiment of an electrical connector incorporating the concepts of the invention.

FIG. 6 shows an alternate embodiment of the invention wherein connector 10A again includes a pair of latching cavities 30 having latch plates 68 therewithin. Like reference numerals are applied in FIG. 6 corresponding to like components described above in relation to FIGS. 1–5.

In the embodiment of FIG. 6, a rib 34A is molded integrally with connector housing 14 to span side walls 32 of each latching cavity 30. However, it can be seen in FIG. 6 that integrally molded ribs 34A are generally coincident with board-mounting face 24 of the housing, rather than spaced inwardly of the latching cavities as in the first embodiment of FIGS. 1 and 2. With this embodiment, holes 66 (FIGS. 4 and 5) in solder plates 52 are not blocked by any core pins of the molding die assembly. Consequently, the molten plastic material which forms ribs 34A is allowed to pass through openings 66 to form a pair of plastic locating pegs 72 which surround metal locating pegs 64 of the latch/solder member. These larger plastic locating pegs are designed to be inserted into appropriate larger locating holes in the printed circuit board. Of course, appropriately shaped die portions of the molding die assembly are used to form plastic locating pegs 72.

Finally, and still referring to the embodiment of FIG. 6, it can be seen that each rib 34A is molded with an integral blocking flange portion 74 which projects upwardly into the respective latching cavity 30. Blocking flange portion 74 prevents latch hooks 44 of mating connector 12 from being inserted into latching cavities 30 on the wrong sides of latch plates 68, as described above. Therefore, ribs 34A and blocking flange portions 74 again perform dual functions of strengthening the connector housing between side walls 32 of latching cavities 24 as well as preventing the latch members of the mating connector from being inserted into the latching cavities in improper orientations.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector adapted for mounting on a printed circuit board and for mating with a complementary connecting device, comprising:

a dielectric housing having an upper surface, a lower board-mounting surface and a front mating face extending generally transversely between said surfaces;

a plurality of terminals mounted in said housing;

at least one latching cavity in the front mating face of the housing for receiving a latch member from the complementary mating device, the cavity including opposite side walls extending inwardly of the mating face and generally perpendicular to the upper and lower surfaces of the housing;

a combination latch and solder member mounted on the housing and including at latch plate in the latching cavity between the opposite side walls thereof and a solder plate at the board-mounting face of the housing, the latch member of the complementary connecting device being latchingly engageable with the latch plate at one side thereof; and a blocking section in the latching cavity at an opposite side of the latch plate from said one side thereof to prevent the latch member of the complementary connecting device from being inserted into the cavity on said opposite side of the latch plate.

2. The electrical connector of claim 1 wherein said dielectric housing is molded of plastic material, and said blocking section is molded integrally therewith.

3. The electrical connector of claim 2 wherein said blocking section comprises a rib extending between the opposite side walls of the latching cavity.

4. The electrical connector of claim 3 wherein said rib is spaced from said latch plate and from the board-mounting face of the housing.

5. The electrical connector of claim 3 wherein said rib is generally coincident with the board-mounting face of the housing.

6. The electrical connector of claim 5 wherein the molded plastic material of said rib projects through an opening in said solder plate to form a locating peg for insertion into an appropriate locating hole in the printed circuit board.

7. The electrical connector of claim 6 wherein said rib has a blocking flange portion projecting therefrom toward the latch plate of the latch and solder member.

8. An electrical connector adapted for mounting on a printed circuit board and for mating with a complementary connecting device, comprising:

a housing molded of dielectric plastic material and having an upper surface, a lower board-mounting surface and a front mating face extending generally transversely between said surfaces;

a plurality of terminals mounted in said housing;

at least one latching cavity in the front mating face of the housing for receiving a latch member from the complementary mating device, the cavity including opposite side walls extending inwardly of the mating face and generally perpendicular to the upper and lower surfaces of the housing;

a combination latch and solder member mounted on the housing and including at latch plate in the latching cavity between the opposite side walls thereof and a solder plate at the board-mounting face of the housing, the latch member of the complementary connecting device being latchingly engageable with the latch plate at one side thereof, the solder plate including an opening aligned with the latching cavity; and a rib integrally molded with the housing between the opposite side walls of the latching cavity generally at the board-mounting face of the housing, the plastic material of the rib projecting through the opening in the solder plate to form a locking peg for insertion into an appropriate locating hole in the printed circuit board.

9. The electrical connector of claim 8 wherein said rib has a blocking portion extending into the latching cavity toward said latch plate to prevent the latch member of the complementary connecting device from being inserted into the cavity at an opposite side of the latch plate from said one side thereof.

* * * * *